US007077500B2

(12) United States Patent
Yabe

(10) Patent No.: US 7,077,500 B2
(45) Date of Patent: Jul. 18, 2006

(54) INK JET HEAD AND INK JET PRINTER

(75) Inventor: Kenji Yabe, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 151 days.

(21) Appl. No.: 10/419,176

(22) Filed: Apr. 21, 2003

(65) Prior Publication Data

US 2003/0214551 A1 Nov. 20, 2003

(30) Foreign Application Priority Data

Apr. 23, 2002 (JP) ..... 2002-121155
Apr. 18, 2003 (JP) ..... 2003-114485

(51) Int. Cl.
*B41J 2/205* (2006.01)

(52) U.S. Cl. ..... 347/40; 347/43
(58) Field of Classification Search ..... 347/40, 347/12, 43, 15
See application file for complete search history.

(56) References Cited

U.S. PATENT DOCUMENTS 5,208,605 A 5/1993 Drake
6,030,065 A * 2/2000 Fukuhata ..... 347/15
6,109,715 A 8/2000 Masaki
6,315,389 B1 * 11/2001 Torgerson et al. ..... 347/40
6,394,572 B1 * 5/2002 Pierce et al. ..... 347/17
6,457,796 B1 * 10/2002 Fujii ..... 347/12
6,575,560 B1 6/2003 Kaneko et al.
2002/0008729 A1 1/2002 Kaneko et al.

FOREIGN PATENT DOCUMENTS

| | | |
|---|---|---|
| EP | 1 110 743 | 6/2001 |
| EP | 1 228 876 | 8/2002 |
| JP | 11-179920 | 7/1999 |
| JP | 2000-6442 | 1/2000 |
| JP | 2001-171119 | 6/2001 |

OTHER PUBLICATIONS

*Note: U.S. counterpart, patent application Publication No. 2002/0008729 A1, also submitted.

* cited by examiner

*Primary Examiner*—Lamson Nguyen
(74) *Attorney, Agent, or Firm*—Fitzpatrick Cella Harper & Scinto

(57) ABSTRACT

An ink jet head is provided with a plurality of nozzle arrays formed by many numbers of ink nozzles for discharging large-amount ink droplets and small-amount ink droplets. Although the ink jet head generates heat more on the middle portion thereof, it is cooled by discharges of ink droplets. The degree of cooling is greater by the large-amount ink droplets to be discharged. Thus, on the first column in the main scan direction, the small-amount nozzle array is positioned, and on the second column, the large-amount nozzle array is positioned. In this way, it is made possible to balance the temperature distributions in the main scan direction. As a result, color images can be formed in high quality.

10 Claims, 6 Drawing Sheets

INK JET HEAD AND INK JET PRINTER

BACKGROUND OF THE INVENTION

1. Field of the Invention

The present invention relates to the ink jet head of an ink jet printer. More particularly, the invention relates to an ink jet head having a number of ink nozzle arrays arranged in the main scan direction, each of which is provided with a number of ink nozzles arranged in the sub-scan direction.

2. Related Background Art

In recent years, an ink jet printer has been in use generally as a printing apparatus. It is required for such printing apparatus to form images in high quality at high speed. The ink jet printers generally in use form dot-matrix images on a printing sheet by ink droplets discharged from the ink jet head in such a manner that while the ink jet head travels in the main scan direction, the printing sheet moves in the sub-scan direction.

For the generally used ink jet head, many numbers of ink jet nozzles are arranged in the sub-scan direction for the nozzle arrays, and for the full-color use ink jet head, the nozzle arrays are arranged for a primary color or three primary colors in the main scan direction. Also, among ink jet printers, there is the one in which the ink jet head driven to travel in the main scan direction is made to travel in both the forward and backward directions for the high-speed image formation.

For example, the ink jet printer disclosed in the specification of Japanese Patent Application Laid-Open No. 2001-171119 is arranged to provide the ink jet head thereof with two columns of nozzle arrays each for use of the three primary colors, YMC. Such nozzle arrays for the YMC use are arranged to be symmetrical in the main scan direction.

In other words, six columns of nozzle arrays are formed in the order of a first C use, a first M use, and a first Y use, and a second Y use, a second M use, and a second C. Then, for the first YMC uses, and the second YMC uses, ink nozzles are arranged in the same cycle, but the phases thereof are arranged to be reciprocal just by a portion equivalent to a half cycle.

Then, the ink jet printer disclosed in the specification of the aforesaid Japanese Patent Application, for example, operates the nozzle arrays of the first and second YMC use both in the reciprocal traveling of the ink jet head so as to print high resolution images at high speed. Here, the first and second nozzle arrays of the ink jet head for the YMC use are arranged in the same cycle but in the phases which are reversal just by a portion equivalent to a half cycle. Therefore, the arrangement density of the main-scanning columns of YMC colors of a printed image in the sub-scan direction is made twice as much of the arrangement density of the ink nozzles of each nozzle array. Consequently, the printed image thereof is in high resolution.

In this respect, even the pixel, on which ink droplets of YMC colors are impacted at the same position on a printing sheet, may result in different coloring depending on the impact order of ink droplets, "YMC" or "CMY". However, in accordance with the ink jet printer disclosed in the specification of the aforesaid Japanese Patent Application, the first and second YMC use are arranged symmetrically in the main scan direction for the ink jet head that forms images both in the reciprocal traveling to make it possible to from the pixel having the impact order of "YMC" and the pixel having the impact order of "CMY" both in the reciprocal traveling of the ink jet head. The resultant coloring of the printed image is excellent.

Also, in the specification of the aforesaid Japanese Patent Application, it is also disclosed that only the first nozzle array for YMC use can be operated in the forward movement of the ink jet head, and only the second nozzle array is operated in the backward movement so that an image of low resolution can be formed at high speed with only the pixels having the same impact order.

The ink jet head disclosed in the specification of the aforesaid Japanese Patent Application is capable of forming high-resolution color images at high speed in a good coloring condition. However, in recent years, it has been required to provide images in a quality still higher. In order to enhance the image quality in the general printing, it should be good enough if only the diameter of each ink nozzle is made smaller, while the ink nozzles are arranged in higher density. For the ink jet head, a driving element is incorporated in each of the ink nozzles, which is wired to a driving circuit. Therefore, the enhancement of the arrangement density depends on the manufacturing technologies and techniques thereof.

Here, with respect to the formation method of color images by use of an ink jet printer, the pseudo-formation of the secondary colors are executed by changing the impact density of ink droplets of YMC colors on a printing sheet. As a result, the pixel density of the secondary colors becomes far larger than the impact density of the ink droplets of YMC colors eventually. For example, if should it be possible to adjust the liquid amount of ink droplet freely per ink nozzle, the pixel density of the secondary colors can be made equal to the impact density of the ink droplet. However, it is extremely difficult to arrange this with a generally used ink jet head.

Here, the problem of the arrangement density described above can be solved in such a way that the nozzles for use of large liquid droplets and the nozzles for use of small liquid droplets are arranged individually to be able to discharge ink liquid droplets in the direction perpendicular to the heater board, which is the substrate having heat generating resistive elements formed thereof for use of discharging ink.

For the aforesaid mode, in which ink droplets are discharged in the direction perpendicular to the heater board having the heat generating resistive elements formed for use of ink discharge use, there is a need for the installation of a plurality of ink supply ports for supplying liquid of each color to one heater board when discharge ports for use of a plurality of colors are provided for one heater board. Further, in order to attain the high-speed printing, it is required to increase the number of heaters on one heater board, and the number of discharge ports arranged for each of the heaters as well.

Moreover, the size of the heater board tends to be made larger with the increased numbers of heaters and ink supply ports on one heater board. Nevertheless, in order to manufacture a recording head at cost of as lower as possible, it is necessary to downside the heater board as much as possible. As a result, there is a need for making the areas other than the one occupied by the heaters on the heater board as small as possible.

Now, generally, for an ink jet head, the discharge element that discharges ink is incorporated per ink nozzle, and also, the driving circuit and others are incorporated for driving the discharge element. When these element and driving circuits are driven, heat is generated unavoidably, because these members are actuated by means of electric power.

In this respect, the causes of heat generation of the ink jet head described above are heat generated by the discharge element that discharge ink per ink nozzle; heat generated by the driving circuit that drives the discharge element; and heat generated by wiring that connects the driving circuit and the discharge element, among some others. However, when ink is heated by the discharge element to bubble for effectuating discharge from the heat-generating element, the heat generation is particularly conspicuous by the heat-generating element. At the same time, cooling is also conspicuous by the discharge of the ink droplet thus heated.

Further, the ink jet head that performs discharges by bubbling ink by means of heating given by the heat-generating element is caused to change the temperature of ink retained inside thereof when the temperature of the head changes. As a result, the timing of bubbling and discharging is caused to fluctuate. Consequently, for example, if the temperature of the ink jet head changes significantly at a position in the main scan direction, the timing of ink droplet discharges by the plural nozzle arrays thus arranged is not synchronized, leading to the degradation of the quality of images to be formed.

On the other hand, when a plurality of ink supply ports are arranged in parallel on the substrate for use of a plurality of colors as described above, the ink supply ports themselves provide function to insulate the thermal conduction to the inside of the head. This may present a cause that inevitably generate the varied head temperatures between each of the ink supply ports depending on the nozzle array structure on the portion laying between the ink supply ports inside the head.

SUMMARY OF THE INVENTION

The present invention is designed with a view to solving the problems discussed above. It is an object of the invention to provide an ink jet head capable of forming color images in high quality.

The ink jet head of the present invention, which is movable in the main scan direction for discharging ink droplets from any ink nozzles at the time of moving in the main scan direction to a printing medium in a position facing the printing medium to be moved in the sub-scan direction, comprises a plurality of first nozzle arrays formed by the nozzles for discharging ink droplets arranged in the main scan direction; a plurality of second nozzle arrays formed by the nozzles for discharging ink droplets in smaller amount than that of the first nozzle arrays arranged in the main scan direction; a plurality of ink supply ports each in the form of elongated hole extended in the main scan direction; and a substrate having a plurality of heat generating elements provided correspondingly for nozzles of the first and second nozzle arrays. For this ink jet head, each one of the first nozzle arrays and second nozzle arrays is arranged, respectively, between each of the plural ink supply ports.

With the structure arranged as described above, the large-amount nozzle array and the small-amount nozzle array are positioned invariably on the space between two ink supply ports.

In this manner, it is made possible to balance the distribution of head temperatures on a plurality of portions positioned between the ink supply ports.

BRIEF DESCRIPTION OF THE DRAWINGS

FIG. 2A is a plane view of the silicon substrate; and FIG. 2B is a vertically sectional front view.

DETAILED DESCRIPTION OF THE PREFERRED EMBODIMENTS

The Structure of the Embodiments

Figure 1:
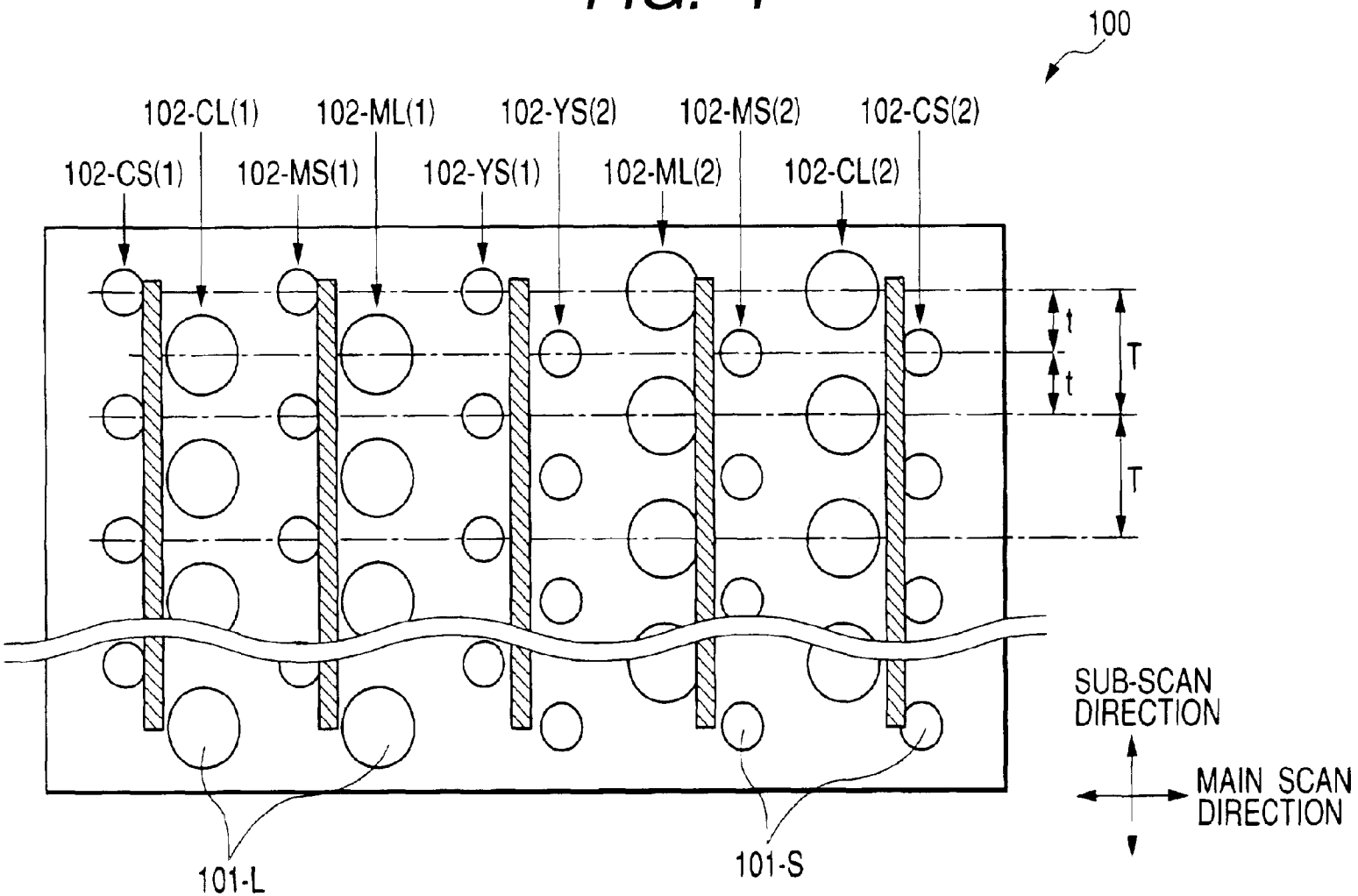
FIG. 1 is a plan view that shows the pattern of ink nozzles of an ink jet head embodying the present invention.

With reference to FIG. 1 to FIG. 5, the description will be made of one embodiment in accordance with the present invention. As shown in FIG. 1, the ink jet head 100 of the present embodiment is formed to be of reciprocal type for full color printing. There are arranged in the main scan direction 10 columns of nozzle arrays 102, each of which is formed by many numbers of ink nozzles 101 arranged in the sub-scan direction.

More precisely, for the ink jet head 100 of the present embodiment, 10 columns of nozzle arrays 102 are formed by the nozzle arrays 102-Y, M, C, which discharge ink droplets D-Y, M, C of the three primary colors, YMC, respectively, and the these nozzle arrays 102Y, M, C for YMC use are arranged symmetrically in the main scan direction centering on the Y use.

Further, the 10-column nozzle arrays 102 of the ink jet head 100 of the present embodiment are formed by the plural nozzle arrays 102-L that discharge ink droplets D-L of a specific first liquid amount, and the plural nozzle arrays 102-S that discharge ink droplets D-S of a liquid amount smaller than the first liquid amount.

For example, the first liquid amount of the ink droplet D-L is 5 pl (pico-liter), and the second liquid amount of ink droplet D-S is 2 pl. In this respect, in order to simplify the description hereunder, the first liquid amount is referred to as "large amount", and the second liquid amount is referred to as "small amount".

More specifically, the nozzle arrays 102-C, M for the C and M use are formed by the large-amount nozzle arrays 102-CL, ML, and the small-amount nozzle arrays 102-CS, MS. However, the nozzle arrays 102-Y are formed only by the small-amount nozzle arrays 102-YS for use of the Y.

As described earlier, these nozzle arrays 102 are arranged symmetrically in the main scan direction centering on the Y use. Therefore, the ink jet head 100 of the present embodiment is provided with the nozzle arrays 102-CS (1), CL (1), MS (1), ML (1), YS (1), YS (2), ML (2), MS (2), CL (2), and CS (2) arranged in that order from one end to the other in the main scan direction.

Therefore, for the ink jet head 100 of the present embodiment, the small-amount nozzle array 102-S is positioned at least on the first column in the traveling direction thereof in the main scan direction, while the large-amount nozzle array 102-L is positioned on the second column. Here, the ink nozzle 101-L that discharges the large-amount ink droplet D-L is formed to be circular having the diameter of 16 μm, for example, and the ink nozzle 101-S that discharges the small-amount ink droplet D-S is formed to be circular having the diameter of 10 μm, for example.

Also, the nozzle arrays 102-Y, M, C for the YMC use are arranged symmetrically in the main scan direction, but for the nozzle arrays 102-(1) and (2) on the left and right sides (in FIG. 1) having the same diameter for the ink droplets D of the same color, the cycle T of the arrangement of ink nozzle 101 is equal, and the phase is reciprocal by a portion equivalent to a half cycle, that is, "t (=T/2)".

Here, for the ink jet head 100 of the present embodiment, the ink nozzles 101 are arranged in a density of 600 dpi (dot per inch) for each of the nozzle arrays 102. Then, the arrangement cycle T of the ink nozzle 101 is approximately 42 μm per nozzle array 102.

Also, for the ink jet head 100 of the present embodiment, the arrangement pitches of the large-amount nozzle array 102-L and those of the small-amount nozzle array 102-S are 1.376 mm, and the arrangement pitch of the adjacent nozzle arrays 102 of the same color is 0.254 mm. Then, between the adjacent large-amount nozzle array 102-L and small-amount nozzle array 102-S of the same color, an ink supply port 111 is arranged.

In other words, the large-amount nozzle 101-L and the small-amount nozzle 101-S are arranged zigzag at a cycle of approximately 21 μm for the same ink supply port 111. Here, then, the small-amount nozzle array 102-S is arranged on the head side in the main scan direction.

Figure 2A:
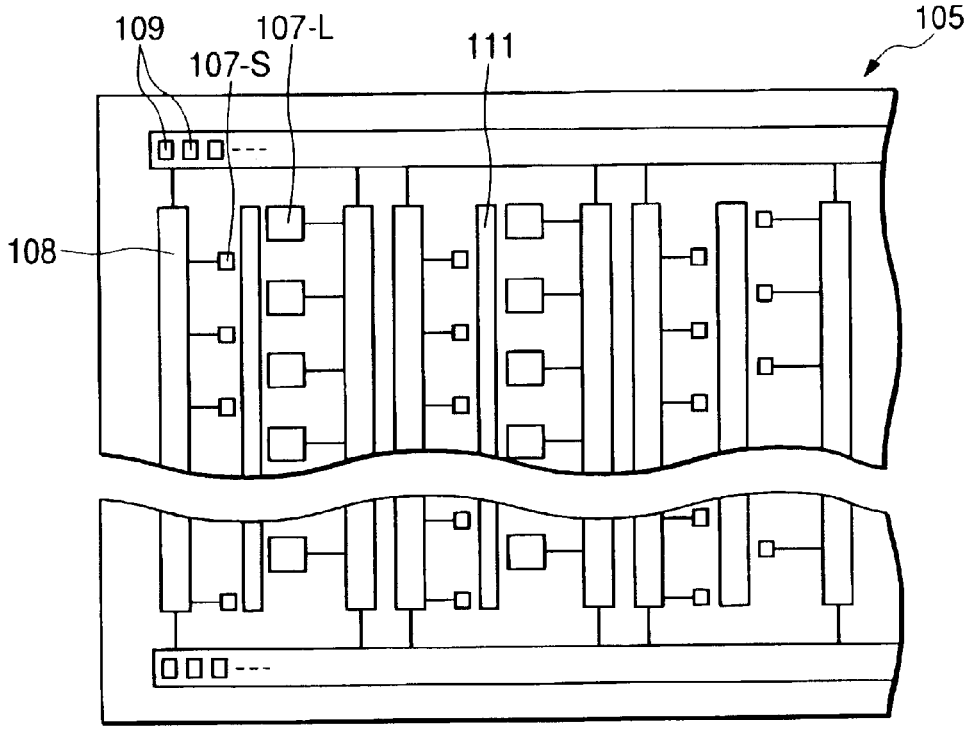
FIGS. 2A and 2B are views that illustrate the inner structure of the ink jet head.
Figure 2B:
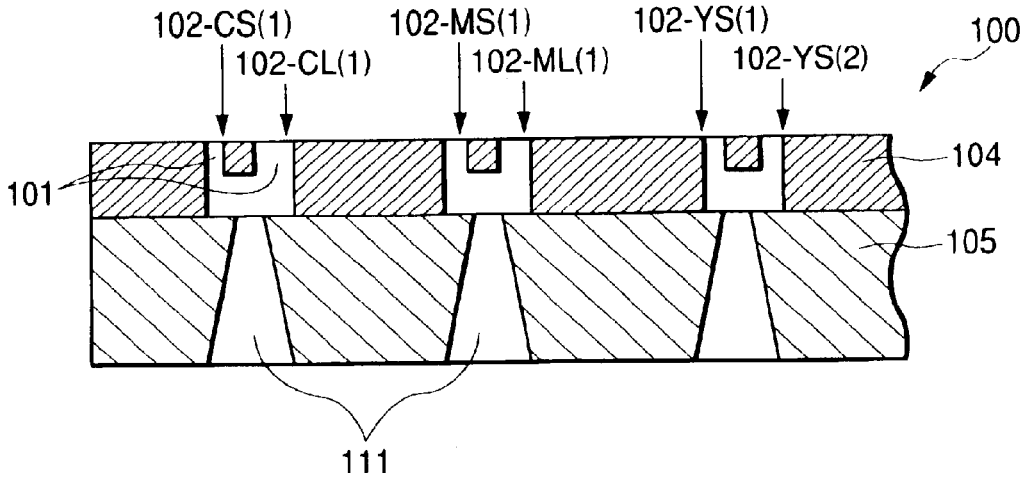

As shown in FIG. 2B, the ink jet head 100 of the present embodiment is provided with an orifice plate 104 and a silicon substrate 105. These are laminated. The ink nozzles 101 are formed for the orifice plate 104, and communicated integrally in the orifice plate 104 for each of the adjacent same-color nozzle arrays 102.

The silicon substrate 105 is formed by (100) silicon, for example, and as shown in FIG. 2A, the heat generating element 107, which serves as ink discharge means, is formed for each position of the ink nozzle 101 on the surface of the silicon substrate. When this heat-generating element 107 causes ink to bubble, the ink droplet D is discharged from the ink nozzle 101.

However, there are large and small ink nozzles 101 as described earlier. Therefore, on the position of the ink nozzle 101-L having a large diameter, a first heat generating element 107-L having a first area of 26×26 μm is formed, and on the position of the ink nozzle 101-S having a small diameter, a second heat generating element 107-S having a second area of 22×22 μm is formed.

On the position to which these heat-generating elements 107 are arranged to be adjacent in the main scan direction, the driving circuit 108 is formed, and the adjacent heat-generating elements 107 are connected with the driving circuit 108. Also, on the positions of the surface of the silicon substrate 105 near both ends in the sub-scan direction, many numbers of connecting terminals 109 are formed, and the driving circuit 108 is connected with the connecting terminals 109.

Here, the space of the driving circuit 108 for use of small-amount nozzles 101-S and the heat-generating element 107 connected therewith in the main scan direction is made savable in the main scan direction than the space of the driving circuit 108 for use of large-amount nozzles 101-L and the heat-generating element 107 connected therewith in the main scan direction.

For the silicon substrate 105, the ink supply path 111 is formed per adjacent nozzle arrays 102 of the same color. Therefore, as shown in FIG. 2B, the ink supply path 111 is commonly communicated with the adjacent nozzle arrays 102 of the same color. In this respect, the ink supply path 111 is formed by means of anisotropic etching on the silicon substrate 105 of (100) silicon. Thus, the sectional shape thereof is formed to be trapezoidal.

Figure 3:
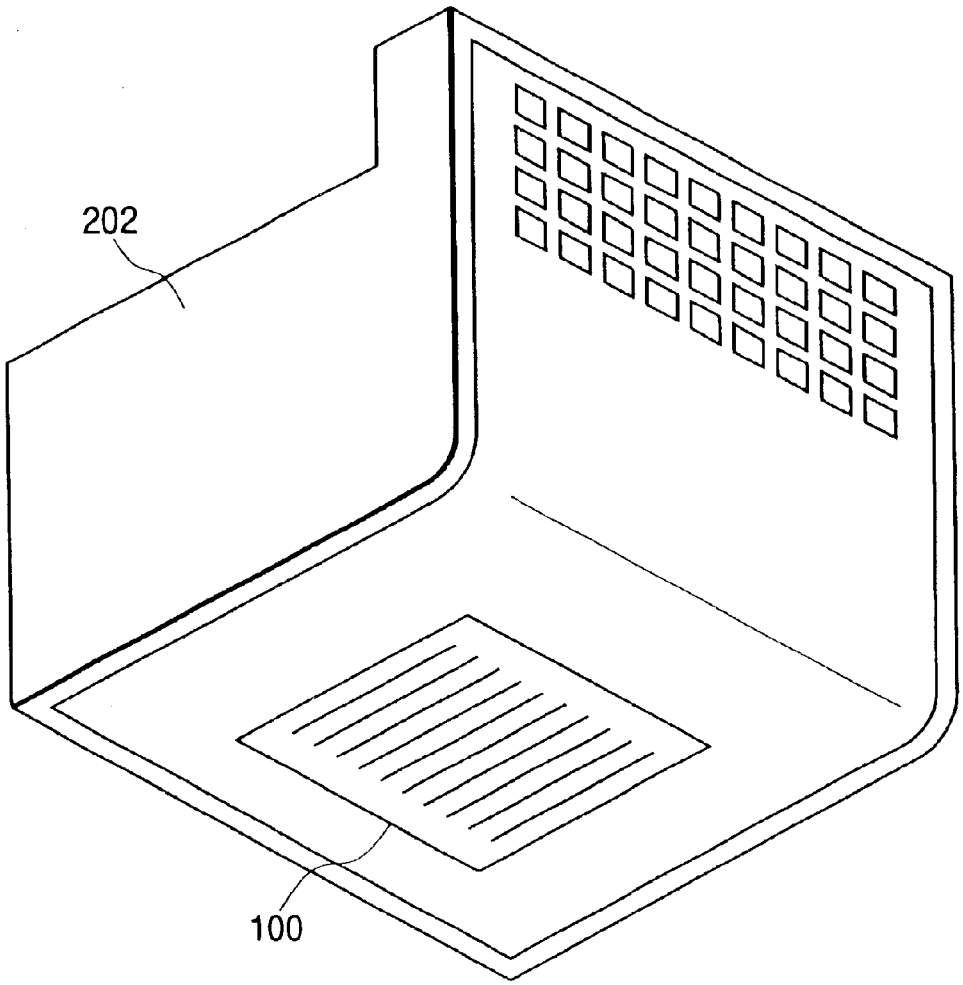
FIG. 3 is a perspective view that shows the state in which the ink jet head is mounted on the head main body.
Figure 4:
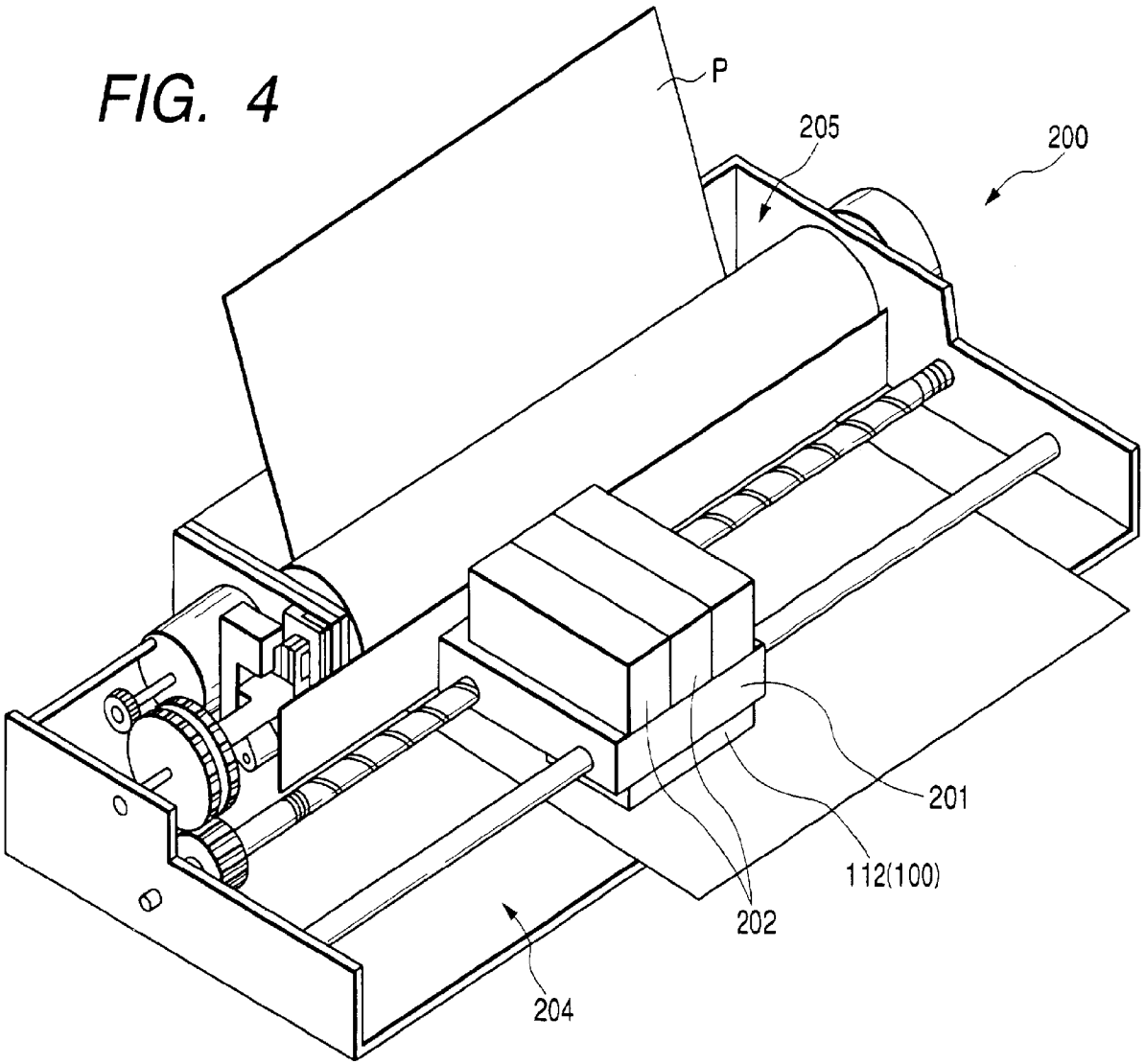
FIG. 4 is a perspective view that shows the inner structure of an ink jet printer embodying the present invention.
Figure 5:
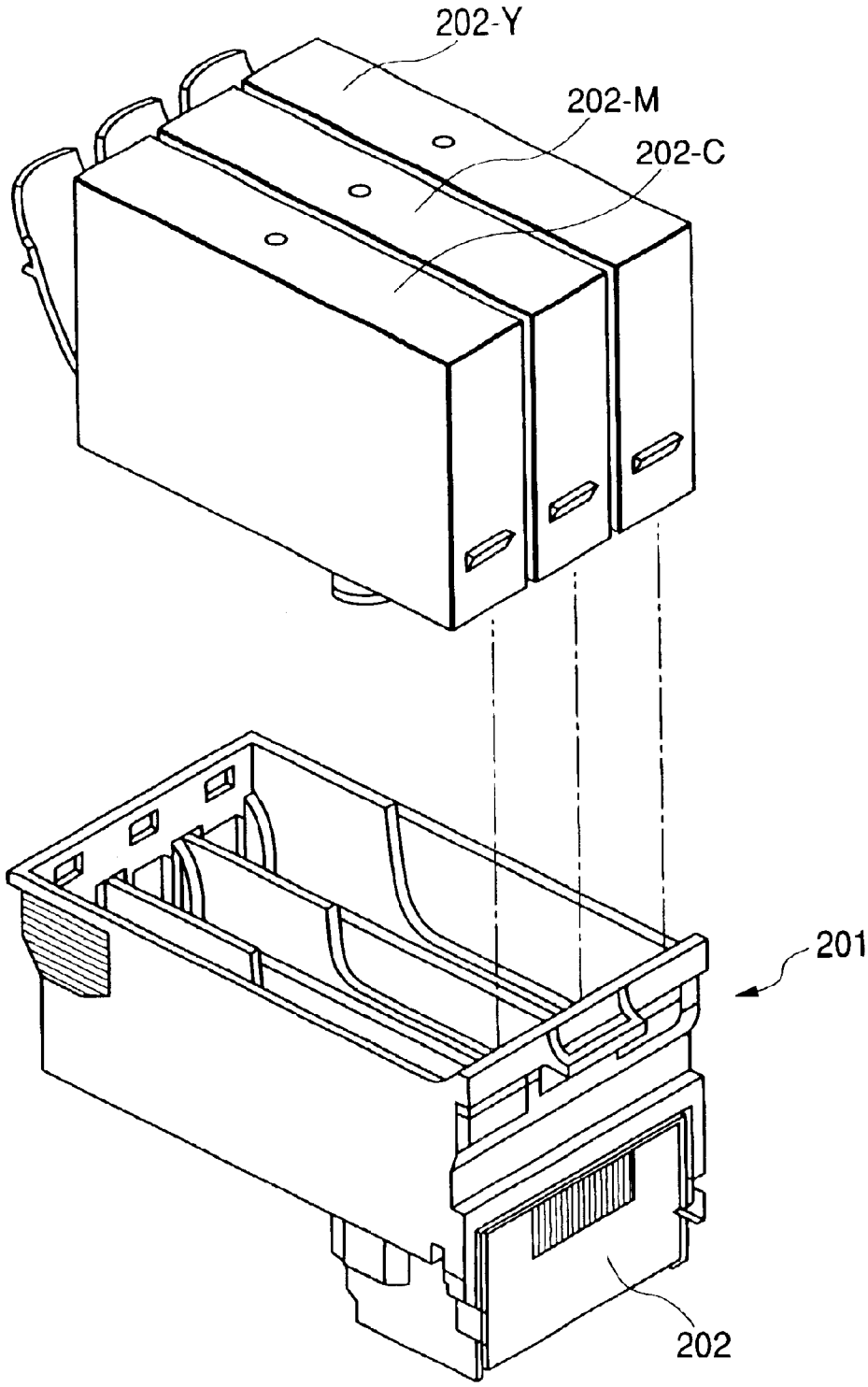
FIG. 5 is an exploded perspective view that shows the state in which ink cartridges are mounted on a carriage.

As shown in FIG. 3 to FIG. 5, the ink jet head 100 of the present embodiment, is formed as a part of an ink jet printer 200, and mounted as shown in FIG. 4 and FIG. 5 on the carriage 201 of the ink jet printer 200.

More precisely, as shown in FIG. 3, the ink jet head 100 of the present embodiment is mounted on the head main body 202, and as shown in FIG. 5, the head main body 202 is mounted on the carriage 201. For the carriage 201, the ink cartridges 202-Y, M, C are detachably mounted for the YMC use. From these ink cartridges 202-Y, M, C, each ink of YMC colors is supplied to the nozzle arrays 102-Y, M, C of the ink jet head 100 for the YMC use, respectively.

Also, as shown in FIG. 4, the ink jet printer 200 of the present embodiment is provided with the main-scan mechanism 204 and the sub-scan mechanism 205. The main-scan mechanism 204 supports the carriage 201 movably in the main scan direction, and the sub-scan mechanism 205 enables a printing sheet P to move in the sub-scan direction on the position facing the ink jet head 100.

Further, the ink jet printer 200 of the present embodiment is provided with an over all control circuit (not shown) formed by a microcomputer, driver circuit, and others, and with this over all control circuit, the ink jet head 100 controls the operations of the main-scan mechanism 204 and the sub-scan mechanism 205 integrally.

With the structure thus arranged, the ink jet printer 200 of the present embodiment is capable of forming color images on the surface of a printing sheet P. In this case, while the printing sheet P moves by use of the sub-scan mechanism 205 in the sub-scan direction 204, the ink jet head 100 reciprocates by use of the main-scan mechanism in the main scan direction. Then, the ink nozzles 101 of the ink jet head 100 discharge ink droplets D to the printing sheet P for the formation of dot matrix color images with the adhesion of ink droplets D to the printing sheet P.

The ink jet printer 200 of the present embodiment is able to set a plurality of operation modes exchangeably, and in the high-quality image mode, which is the base mode thereof, for example, all the nozzle arrays 102 operate both for the forward and backward movements when the ink jet head 100 reciprocates in the main scan direction.

For the ink jet head 100 of the present embodiment, the left and right nozzle arrays 102-(1) and (2), for which the ink droplets D are in the same color and the same diameter, as shown in FIG. 1, the cycle T of the arrangement of the ink nozzles 101 is the same but the phase is reciprocal just by the potion equivalent to a half-cycle t as described earlier. Therefore, it is made possible to arrange the pixels formed by the ink droplets D on a printing sheet P by the cycle t in the sub-scan direction when all the nozzle arrays 102 operate simultaneously as described above.

Further, the ink jet printer 200 of the present embodiment performs the pseudo-formation of the secondary colors by adjusting the densities of the pixels of YMC colors. Here, since the ink jet head 100 of the present embodiment discharges the large-amount ink droplet D-L and the small-amount droplet D-S for the M color and C color selectively, the large and small pixels can be formed freely for the M color and C color, thus enabling the pixel densities of the pseudo-secondary colors to be enhanced.

Here, then, the dot diameters of the large-amount ink droplet D-L and the small-amount ink droplet D-S are within approximately 48 μm and approximately 36 μm, respectively.

In this respect, although only the small-amount ink droplet D-S is discharged for the Y color, there is not much need for the formation of the large and small pixels for the Y color, because this color is close to the white color of a printing sheet P.

Also, the temperature of the ink jet head 100 of the present embodiment is raised as a whole centering on the positions of the nozzle arrays 102 in operation due to the heat generating elements 107, which are formed individually per ink nozzle 101. However, the ink jet head 100 is liquid cooled by discharging ink droplets from the ink nozzles 101. This liquid-cooling action takes place more on the positions of large-amount nozzle arrays 102-L as a matter of course than on the positions of small-amount nozzle arrays 102-S.

Also, on the surface of the ink jet head 100 where a plurality of nozzle arrays 102 are arranged in the main scan direction, the degree of heat generation is greater more on the middle side in the main scan direction due to the accumulation of thermal energy. Further, since the ink jet head 100 of the present embodiment is mounted on the head main body 202, the degree of cooling is greater more on the outer side due to the generation of heat conduction to the head main body 202.

Here, for the ink jet head 100 of the present embodiment, at least on the first column in the traveling direction thereof in the main scan direction the small-amount nozzle array 102-CS is positioned, while the large-amount nozzle array 102-CL is positioned on the second column.

In other words, on the odd-numbers columns observed in the main scan direction, the small-amount nozzle arrays are positioned, and on the even-numbered columns, the large-amount nozzle arrays are positioned. Then, between the arrays of the first column 102-CS and the second column 102-CL, and further, of the third column 102-Ms and the fourth column 102-ML, ink supply ports are positioned. Here, the structure is arranged so that the large-amount nozzle array and the small-amount nozzle array are invariably positioned on the space between the two ink supply ports.

In the case of the ink jet head of the present invention where a plurality of ink supply ports 111 for use of a plurality of colors are arranged in parallel, the ink supply ports themselves function to insulate the thermal conduction in the head. This insulating function may cause to vary the head temperature due to the existence of nozzles between each of the ink supply ports depending on the nozzle array structure on the portion between the ink supply ports in the head.

Incidentally, the changing ratio of the temperatures of the large-amount nozzle and the small-amount nozzle of the present embodiment due to environmental temperatures thereof is approximately 0.95 (%/° C.) for the former, and 1.26 (%/° C.) for the latter. Particularly, then, the latter is more liable to be affected by the varied amounts of liquid droplets that may be brought about by the environmental temperatures.

However, in accordance with the present embodiment, the structure is arranged to position the large-amount nozzle array and the small-amount nozzle array invariably on the insulated space divided into the plural number in the main scan direction in the head, that is, invariably on each space existing between two ink supply ports. As a result, it becomes possible to balance the temperature distributions on the plural nozzle array portions each of which is between the ink supply ports.

Therefore, not much difference exists in the temperatures of the ink jet head 100 in any positions in the main scan direction to make it possible to prevent the image quality from being degraded due to the event that the discharge timing of ink droplets is not synchronized for the plural nozzle arrays 102 thus arranged.

Now that the ink jet head 100 of the present embodiment uses the large-amount ink droplet D-L and the small-amount ink droplet D-S when forming color images as described above, it becomes possible to enhance the densities of secondary color pixels of the image to be formed. The resultant image quality is excellent. Here, for the Y color that has a lesser amount of influence on the image quality, only the small-amount nozzle arrays 102-YS (1) and YS (2) are arranged. Therefore, the structure of the head is made simpler, smaller, and lighter in weight. Also, it is possible to materialize the enhancement of productivity.

Further, the ink jet head 100 of the present embodiment is provided with each two columns of nozzle arrays 102 of the same color, and one ink supply path 111 is commonly communicated with each of the two nozzle arrays 102 of the same color. As a result, the numbers of ink supply paths 111 is reduced. Thus, the structure of the ink jet head 100 is made simpler, and the productivity is enhanced accordingly.

Further, for the ink jet head 100 of the present embodiment, the small-amount nozzle array 102-S is positioned on the first column in the traveling direction thereof in the main scan direction, while the large-amount nozzle array 102-L is positioned on the second column. In other words, a plurality of columns of ink supply ports are arranged in parallel in the main scan direction, and even if heat insulating spaces are created in the plural number, it is possible to balance the temperature distributions on each of the heat insulating spaces by means of the nozzle arrays embodying the present invention.

As a result, there is a lesser amount of fluctuation in the amounts of liquid droplets to be discharged due to the temperature difference that may take place between the plural nozzle arrays 102 arranged in the main scan direction, and the discharge timing is always synchronized so as to form color images in good quality.

In this respect, on the ink jet head 100 that moves in the main scan direction, the air outside functions as the airflow that relatively moves in the main scan direction. The deviation of discharge direction of ink droplet D due to this airflow takes place more on the small-amount ink droplet D-S than the large-amount ink droplet D-L. Then, if the degree of deviation is different for the large-amount ink droplet D-L and the small-amount droplet D-S, the image quality of the color image to be formed is degraded eventually.

Figure 6:
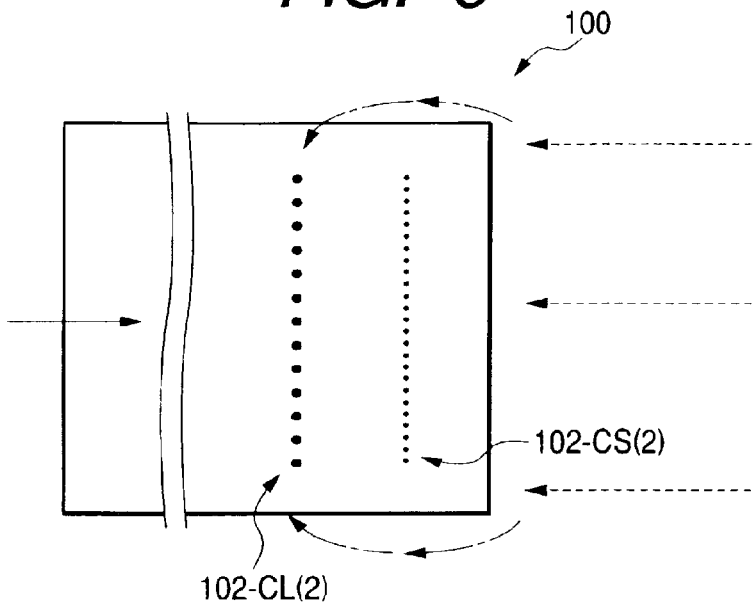
FIG. 6 is a view that schematically shows the state in which ink mist is collected by means of turning airflow.

Here, therefore, with an appropriate setting of the traveling speed in the main scan direction; the contour; the gap between the edge portion and first nozzle array 102 on the first column in the main scan direction; the gap between the edge portion and the nozzle array 102 on the surface of the second column, among some others, it is made possible to enable the aforesaid airflow to act on the position of the surface of the second column rather than on the position of the first-column nozzle array 102 as shown in FIG. 6. In this case, the difference in the degrees of deviation between the large-amount ink droplet D-L and the small-amount ink droplet D-S can be reduced, hence making it possible to prevent the quality of color image to be formed from being degraded.

Modified Example of the Embodiment

For the embodiment described above, it has been illustrated that the nozzle arrays 102 for the YMC use are formed for the ink jet head 100. Further, it is possible to add the nozzle array 102 for K (black) use, and also, to add the nozzle array 102 for use of color other than the YMC (neither of them shown).

Likewise, for the embodiment described above, it has been illustrated that only the ink jet head for the YMC use is mounted on the ink jet printer 200. Further, it is possible to mount the ink jet head for the K use, and also, to mount the ink jet head 100 for use of color other than the YMC (neither of them shown).

Further, for the embodiment described above, it has been illustrated that all the nozzle arrays 102 are always in operation when the ink jet printer 200 enables the ink jet head 100 to reciprocate in the main scan direction. For example, however, it is made possible to operate only the nozzle arrays 102-(1) in FIG. 1 when the ink jet head 100 travels to the right-hand side, and to operate only the nozzle arrays 102-(2) when it moves to the left-hand side.

Also, for the embodiment described above, it has been illustrate that the nozzle arrays 102 are arranged symmetrically in the main scan direction of the ink jet head 100, and that the ink jet head 100 operates both in the forward and backward movement in the main scan direction. For example, however, it is made possible for the ink jet head 130 to operate only an ink jet head (not shown) having a structure of a half portion on the right-hand side in FIG. 1 when it moves to the right-hand side.

Figure 7:
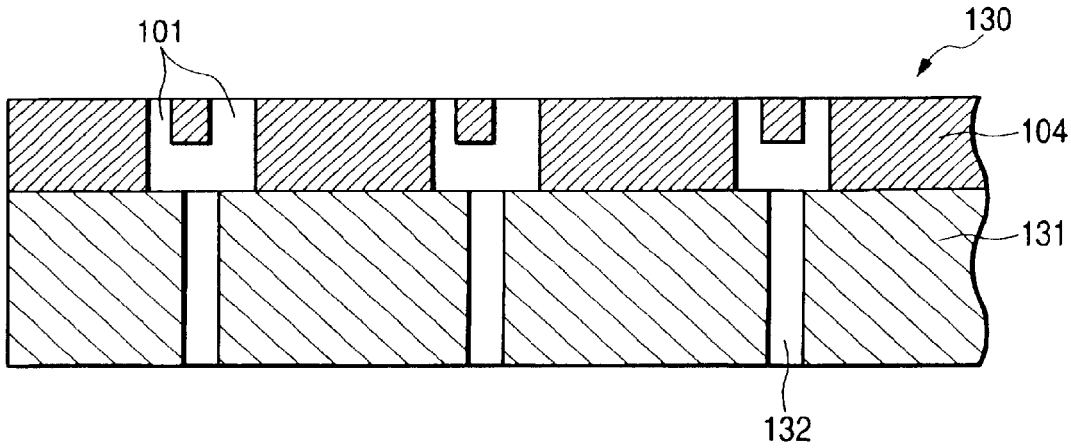
FIG. 7 is a vertically sectional front view that shows the inner structure of an ink jet head in accordance with a first modified example.

Further, for the embodiment described above, it has been illustrated that the ink supply paths 111 are formed on the silicon substrate 105 of (100) silicon by means of anisotropic etching, thus making the sectional shape thereof trapezoidal. However, as shown in FIG. 7, it is also possible to make the sectional shape linear by forming the ink supply paths 132 on the silicon substrate 131 of (110) silicon by means of anisotropic etching. Also, it is possible to from ink supply paths linear, irrespective of the surface orientation of the silicon substrate, by forming the ink supply paths using laser process or sand blast, not anisotropic etching.

Further, for the embodiment described above, it has been illustrated that the large and small ink nozzles 102-L and S that discharge the large and small ink droplets D are combined with the large and small heat generating elements 107-L and S. For example, however, it is not impossible to combine ink nozzles 102 of a specific size with the large and small heat generating elements 107-L and S or to combine the large and small ink nozzles 102 with heat generating elements 107 of a specific size.

Also, for the embodiment described above, it has been illustrated that the heat-generating element 107 is adopted as ink discharge means for discharging ink droplets D from the ink nozzles 101. However, it may be possible to adopt vibrating element (not shown) instead. Further, for the embodiment described above, various numerical values are specifically shown as example. It is of course possible to change variously such specific values thus indicated for illustration.

What is claimed is:

1. An ink jet head movable in a main scan direction for discharging ink droplets to a printing medium from any ink nozzles at the time of moving in the main scan direction, said ink jet head being disposed in a position facing the printing medium and the printing medium being movable in the sub-scan direction, said ink jet head comprising:

a plurality of first nozzle arrays formed by at least some of said nozzles for discharging ink droplets, said first nozzle arrays being arranged in the main scan direction;

a plurality of second nozzle arrays formed by at least some of said nozzles for discharging ink droplets, each ink droplet containing an amount of ink smaller than the amount of ink contained in each ink droplet discharged by said first nozzle arrays, said second nozzle arrays being arranged in the main scan direction;

a plurality of ink supply ports each in the form of an elongated hole, said ink supply ports being arranged in the main scan direction; and a substrate having a plurality of heating generating elements provided correspondingly for nozzles of said first and second nozzle arrays, wherein, between each pair of said ink supply ports, one of said first nozzle arrays and one of second nozzle arrays are arranged, and wherein the heat generating elements provided for the nozzles of said first nozzle arrays are larger than the heat generating elements provided for the nozzles of said second nozzle arrays.

2. An ink jet head according to claim 1, further comprising:

first to third primary-color nozzles for discharging ink droplets of three primary colors, wherein at least some of said color nozzles among said first to third primary-color nozzles are included in one of said first nozzle arrays and one of said second nozzle arrays adjacent each other in the main scan direction.

3. An ink jet head according to claim 2, wherein said three primary colors are Yellow (Y), Magenta (M), and Cyan (C), and nozzles for discharging C and M ink are included in said first nozzle arrays and said second nozzle arrays, and nozzles for discharging Y ink are included in either one of said first nozzle arrays and said second nozzle arrays.

4. An ink jet head according to claim 3, wherein the nozzle arrays for discharging Y, M and C ink are symmetrically arranged in the main scan direction, centered about the nozzle arrays for discharging Y ink.

5. An ink jet head according to claim 4, wherein each ink supply port communicates in common with a pair of adjacent nozzle arrays that discharge ink of the same color.

6. An ink jet head according to claim 5, wherein at least an orifice plate having said nozzle arrays formed therefor, and at least a silicon substrate having said ink supply ports formed therefor, are laminated together, and said silicon substrate is formed of (110) silicon.

7. An ink jet head according to claim 1, wherein said ink jet head reciprocates in the main scan direction, and in at least one direction of the reciprocation, one of said first nozzle arrays is positioned as the first array, and one of said second nozzle arrays is positioned as the second array.

8. An ink jet printer comprising:

an ink jet head according to claim 1;

a main-scan mechanism for enabling said ink jet head to move in the main scan direction;

a sub-scan mechanism for enabling the printing medium to move in the sub-scan direction in a position facing said ink jet head; and an overall control circuit for integratedly controlling the operation of said ink jet head, said main-scan mechanism, and said sub-scan mechanism.

9. An ink jet head according to claim 1, wherein discharge ports provided for nozzles of said first nozzle arrays are larger than discharge ports provided for nozzles of said second nozzles arrays.

10. A substrate used for ink jet head having a first nozzle array arranged in a main scan direction, a second nozzle array arranged in the main scan direction, nozzles of said second nozzle array having a nozzle diameter smaller than nozzles of said first nozzle array, said ink jet head being movable in the main scan direction for discharging ink droplets to a printing medium from any ink nozzles at the time of moving in the main scan direction, and said ink jet head being disposed in a position facing the printing medium, said substrate comprising:

a plurality of ink supply ports each in the form of an elongated hole extending in the main scan direction;

a plurality of first heat generating elements provided correspondingly for said nozzles of said first nozzle array; and a plurality of second heat generating elements provided correspondingly for said nozzles of said second nozzle array, said first heat generating elements being larger than said second heat generating elements, wherein, between each pair of said ink supply ports, at least some of said first heat generating elements and at least some of said second heat generating elements are arranged.

* * * * *

UNITED STATES PATENT AND TRADEMARK OFFICE

CERTIFICATE OF CORRECTION

PATENT NO. : 7,077,500 B2
APPLICATION NO. : 10/419176
DATED : July 18, 2006
INVENTOR(S) : Kenji Yabe It is certified that error appears in the above-identified patent and that said Letters Patent is hereby corrected as shown below:

COLUMN 2
Line 57, “lower” should read --low--.

COLUMN 3
Line 28, “generate” should read --generates--.
Line 50, “elongated” should read --an elongated--.

COLUMN 6
Line 17, “over all” should read --overall--.

COLUMN 7
Line 18, “odd-numbers” should read --odd-numbered--.
Line 23, “102-Ms” should read --102-MS--.

COLUMN 8
Line 67, “illustrate” should read --illustrated--.

COLUMN 9
Line 13, “from” should read --form--.
Line 32, “example.” should read --examples.--.
Line 53, “heating” should read --heat--.

Signed and Sealed this

Tenth Day of April, 2007

JON W. DUDAS
*Director of the United States Patent and Trademark Office*